United States Patent [19]

Hirano et al.

[11] Patent Number: 4,678,416

[45] **Date of Patent: * Jul. 7, 1987**

[54] ROTARY TYPE FLUID MACHINE

[75] Inventors: Takahisa Hirano; Shoji Fukami; Mitsutosho Maeda, all of Nagoya, Japan

[73] Assignee: Mitsubishi Jukogyo Kabushiki Kaisha, Japan

[ * ] Notice: The portion of the term of this patent subsequent to Jul. 7, 2004 has been disclaimed.

[21] Appl. No.: 738,094

[22] Filed: May 24, 1985

[30] Foreign Application Priority Data

May 25, 1984 [JP] Japan ..... 59-105971

[51] Int. Cl.[4] ..... F01C 1/04

[52] U.S. Cl. ..... 418/55; 418/150

[58] Field of Search ..... 418/55, 150

[56] References Cited

U.S. PATENT DOCUMENTS 4,441,870 4/1984 Ikegawa et al. ..... 418/150 X
4,558,997 12/1985 Sakata et al. ..... 418/55

FOREIGN PATENT DOCUMENTS 9355 4/1980 European Pat. Off. ..... 418/55
1628418 7/1977 Fed. Rep. of Germany ..... 418/55
848889 11/1939 France ..... 418/55
58-101285 6/1983 Japan ..... 418/55
59-63388 4/1984 Japan ..... 418/55

*Primary Examiner*—Robert E. Garrett
*Assistant Examiner*—Joseph M. Pitko
*Attorney, Agent, or Firm*—McGlew and Tuttle

[57] ABSTRACT

A rotary fluid machine of the type including two spiral elements, or a stationary spiral element and a revolving spiral element having identical configurations and disposed 180 degrees apart from each other in mutually nested relationship. The revolving spiral element is adapted to revolve in solar motion relationship with respect to the stationary spiral element with a radius of revolutionary motion $\rho$. Both spiral elements are respectively defined in profile with a radially outer curve segment consisting of an involute curve, a radially inner curve segment consisting of another involute curve in an arc having a radius R, and an arc of a radius r connecting smoothly the radially outer curve segment and the arc having the radius R, whereby the radially inner leading end of the spiral elements incorporated may well be protected from possible damages as encountered during the operation of the machine, and the height of spiral elements may readily be increased substantially without making greater the overall outer diameter of the spiral elements, to give the machine a larger capacity.

1 Claim, 10 Drawing Figures

ROTARY TYPE FLUID MACHINE

BACKGROUND OF THE INVENTION (i) Field of the Invention

The present invention relates generally to a rotary machine, and more specifically to a rotary type fluid machine.

(ii) Description of the Prior Art

The typical construction of a scroll-type compressor, for instance, generally known in art of the fluid compression machines as shown in FIG. 4, a schematic view showing the general principle of operation, is such that there are provided two scroll or spiral elements of an identical cross-sectional shape, one spiral element 2 being fixed in position onto the surface of a sealing end plate having a generally central delivery opening 4. Further to this construction, these two spiral elements are shifted in rotation relatively 180 degrees apart from each other and are also shifted in relative location by a distance 2 $\rho$ (=the pitch of a spiral pattern−2×thickness of a spiral element plate) so as to be nested in position with each other in such a manner as schematically shown in the figure that they may be located in their relative position to come in contact with each other at four points 51, 52 and 51', 52'. According to this construction, it is further noted that the one spiral element 2 is disposed stationary in position, and the other element 1 is arranged to move in revolution or in solar-orbital motion with a radius of $\rho=0$, 0' about the center 0 of the spiral element 2, without moving in rotation or in planetary motion on its own axis, by using a crank mechanism having a radius $\rho$.

With such construction, there are defined small spaces or chambers 3, 3 being tightly enclosed extending along and between the abutting points 51, 52 and 51', 52' of the spiral elements 1, 2, respectively, the volumes of which chambers 3, 3 vary gradually in continuation with the solar or revolving motion of the spiral element 1.

Reviewing more specifically, it is notable that when the spiral element 1 is first caused to be revolved 90 degrees starting from the state shown in FIG. 4 (A), it turns to the position as shown in FIG. 4 (B), then when it is revolved 180 degrees, then it turns to the state as shown in FIG. 4 (C), and when it is further revolved 270 degrees, it turns then to the state as shown in FIG. 4 (D). As the spiral element 1 moves along in revolution, the volumes of the small chambers 3, 3 decrease gradually in continuation, and eventually, these chambers come in communication with each other and merge into one tightly enclosed small chamber 53. Now, when it moves in revolution further 90 degrees from the state shown in FIG. 4 (D), it turns back to the position as shown in FIG. 4 (A), and the small chamber 53 would then be caused to be reduced in its volume as it turns from the state shown in FIG. 4 (B) to that shown in FIG. 4 (C), and eventually it would turn to a smallest volume intermediate the states shown in FIGS. 4 (C) and (D). During this stage of motion in revolution, outer spaces starting to be opened as seen in FIG. 4 (B) grow as the element 1 turns along from the state of FIG. 4 (C) through the state of FIG. 4 (D) to the state of FIG. 4 (A), thus introducing another volume of fresh air from these outer spaces into the tightly enclosed small chamber to be eventually merged together, and then repeating this cycle of revolutional motion so that the gas thus-taken into the outer spaces of the spiral elements may accordingly be compressed, thus being delivered out of the delivery opening 4.

The foregoing description is concerned with the general principle of operation of the scroll-type compressor, and now, referring more concretely to the construction of this scroll-type compressor by way of FIG. 5 showing in longitudinal cross-section the general construction of the compressor, it is seen that a housing 10 is comprised of a front end plate 11, a rear end plate 12 and a cylinder plate 13. The rear end plate 12 is provided with an intake port 14 and a delivery port 15 extending outwardly therefrom, and further installed securely with a stationary scroll member 25 comprising a spiral or helical fin 252 and a disc 251. The front end plate 11 is adapted to pivotally mount a spindle 17 having a crank pin 23. As typically shown in FIG. 6 which is a transversal cross-sectional view taken along the plane defined by the arrow VI—VI in FIG. 5, in operative relationship with the crank pin 23 there is seen provided a revolving scroll member 24 including a spiral element 242 and a disc 241, through a revolving mechanism, which comprises a radial needle bearing 26, a boss 243 of the revolving scroll member 24, a square sleeve member 271, a slider element 291, a ring member 292 and a stopper lug 293 and the like.

According to the general construction of this scroll type compressor, it is generally designed that the small volume chamber 53 would gradually reduce in its volume as the revolving element rotates in revolutionary motion, thus having the fluid under pressure delivered out of its delivery port. With the existing thickness of the spiral elements involved therein, however, it is inevitable that the volume of the small chamber could not be made nullified at all, thus resulting in the so-called top clearance volume left unnullified. In this connection, it is notable that the fluid remaining under pressure in the this top clearance volume would then be held from being delivered out of the delivery port 4, which would possibly be turned to be led back to the small chambers 3, 3, after all. As a consequence, it is to be noted that the extent of work done by the compression machine upon the fluid left in the top clearance volume would then turn out to be a loss of work, accordingly.

In the attempt to cope with such drawback as noted above, there has been proposed the rotary type fluid machine which is equipped with the scroll or spiral elements of the construction as typically shown in FIG. 7 under the Japanese patent application No. 206,088/1982.

Referring more specifically to this construction, there is shown the stationary spiral element designated at the reference numeral 501, wherein the curves of the radially outer and inner surfaces of the spiral element 501 are designated at 601 and 602, respectively. It is seen that the radially outer curve 601 is defined as an involute curve having the base circle radius b and the starting point A, the curve section E-F of the radially inner curve 602 is an involute curve having the shift in phase of ($\pi-\rho$/b) with respect to the radially outer curve 601, and the curve section D-E is an arc having the radius R. Also, the connection curve at 603 for connecting the radially outer and inner curves 601 and 602 is an arc having the radius r. The point A is the starting point of the outer curve 601 in the involute curve, and the point B is the boundary point between the outer curve 601 and the connection curve 603, where the both curves share the same tangential line. The point C is the one that is defined sufficiently outside of the radially outer curve 601, and the point D is the boundary point between the inner curves 602 and the connection curve 603, at which point there are two arcs having the radii R and r in osculating relationship with each other. The point E is the boundary point between the arc section (D-E) of the radially inner curve 602 and the involute curve section E-F, where the both curves share the same tangential line. The point F is the one which exists sufficiently outside of the inner curve 602.

It is noted that the other revolving spiral element 502 is in the identical construction.

Now, the radii R and r may be given with the following equations; that is $$R=\rho+b\beta+d \quad (1)$$

$$r=b\beta+d \quad (2)$$

where, $\rho$ is the radius of revolutionary motion;

b is the radius of a base circle $$d=\frac{b^2-\left(\frac{\rho}{2}+b\beta\right)^2}{2\left(\frac{\rho}{2}+b\beta\right)} \quad (3)$$

$\beta$ is a parameter.

The parameter $\beta$ is equal to an angle defined by a straight line segment passing the origin 0 and the X-axis in the negative quadrant. Two points of intersection of the straight line segment passing the origin 0 and at the angle of $\beta$ and the base circle are seen existing in the line segments $EO_2$ and $BO_1$. It is also seen that the straight line segments $EO_2$ and $BO_1$ extend in osculation with the base circle at the points of intersection noted above.

More specifically, it is noted that the parameter $\beta$ is defined to be a given marginal condition for the establishment of the involute curve for the radially outer and inner curves in the configuration of the spiral element, and conversely that this parameter $\beta$ would eventually define the marginal points E and B for the attainment of a due involute curve.

However, according to the compression machine which incorporates the scroll or spiral elements 252 and 242 having the configuration as noted hereinbefore, it has sometimes been experienced that when in a high load operation in which there exists generally a substantial difference in pressures as found between the low pressure side and the high pressure side of the machine, since the rigidity or stiffness of the radially inner leading end of the spiral element as shown by an arrow in FIG. 4 (A) is relatively smaller than that at other portions, there is a high possibility that this particular leading end would turn to be broken during the operation.

For this reason, it is notable that the height of the spiral element would be restricted from being designed to be too large. In this respect, therefore, it is the practice in the design engineering of a large displacement machine that the radius of the base circle b or the radius of revolutionary motion $\rho$, in place of the height, of the spiral element be designed to be greater, thus resulting in an increased overall outer diameter of the spiral element, accordingly. This would, however, be inconvenient in view of the compactness and handling of the rotary machine.

SUMMARY OF THE INVENTION

The present invention is therefore materialized to practice in view of such circumstances and inconveniences as noted above and is essentially directed to the provision of an improved rotary type fluid machine, which can afford an efficient solution to these problems, accordingly. As a consequence, it is a primary object of the present invention to provide an improvement in the rotary type fluid machine that the inner leading end of the spiral element may effectively be protected from being broken during the operation, whereby the height of scroll or spiral elements to be incorporated therein may practicably be designed to be higher than the conventional construction of the scroll-type fluid machines, and whereby there is attained a large volume fluid machine without making the overall other diameter greater, accordingly.

According to the entity of the present invention, there is provided, as briefly summarized, an improved construction of the rotary type fluid machine including two scroll or spiral element, or a stationary spiral element and a revolving spiral element having substantially an identical configuration and disposed therein 180 degrees apart from each other in mutually nested relationship, the revolving spiral element being adapted to revolve in solar motion relationship with respect to the stationary spiral element with a radius of revolutionary motion $\rho$, wherein the both spiral elements are respectively defined in profile with a radially outer curve segment consisting of an involute curve, a radially inner curve segment consisting of another involute curve in an arc having a radius R, and an arc of a radius r connecting smoothly the radially outer curve segment and the arc having the radius R, in accordance with the geometrical relationship as given by the following equations; i.e., $$R=\rho+b\beta+d$$
$$r=b\beta+d$$

$$d=\frac{b^2-\left(\frac{\rho}{2}+b\beta\right)^2}{2\left(\frac{\rho}{2}+b\beta\right)}$$

where, $\beta \geqq 135°$, and b is the radius of a base circle of said involute curve.

By virtue of such an advantageous construction as noted above, there is assured such effect and function that a large capacity fluid machine may be made available from an improvement in construction such that the radially inner leading end of scroll or spiral elements incorporated in the rotary fluid machine may well be protected from possible damages as encountered during the operation of the machine, and that the height of spiral elements may be designed to be greater than the conventional construction of the machine without making greater the outer diameter of the spiral elements, which may immediately be made available to the industry with a substantial benefit, accordingly.

Additional features and advantages of the invention will now become more apparent to those skilled in the art upon consideration of the following detailed description of a preferred embodiment exemplifying the best mode of carrying out the invention as presently perceived. The detailed description refers particularly to the accompanying drawings.

DETAILED DESCRIPTION OF THE INVENTION

The present invention will now be explained by way of a preferred embodiment thereof as adapted in practice to the rotary type fluid machine in reference to the drawings attached herewith. Now, the reference is made to FIG. 1 which is the front elevational view of the spiral element by way of the present embodiment of the invention, FIG. 2 graphic representation showing the mutual relationship between the parameter $\beta$ and the stress working on the inner leading end of the spiral element shown in FIG. 1, and FIG. 3 is a similar elevational view to FIG. 1 showing the configuration of the spiral element shown in FIG. 1 with the parameter $\beta$ of 135 degrees.

Figure 1:
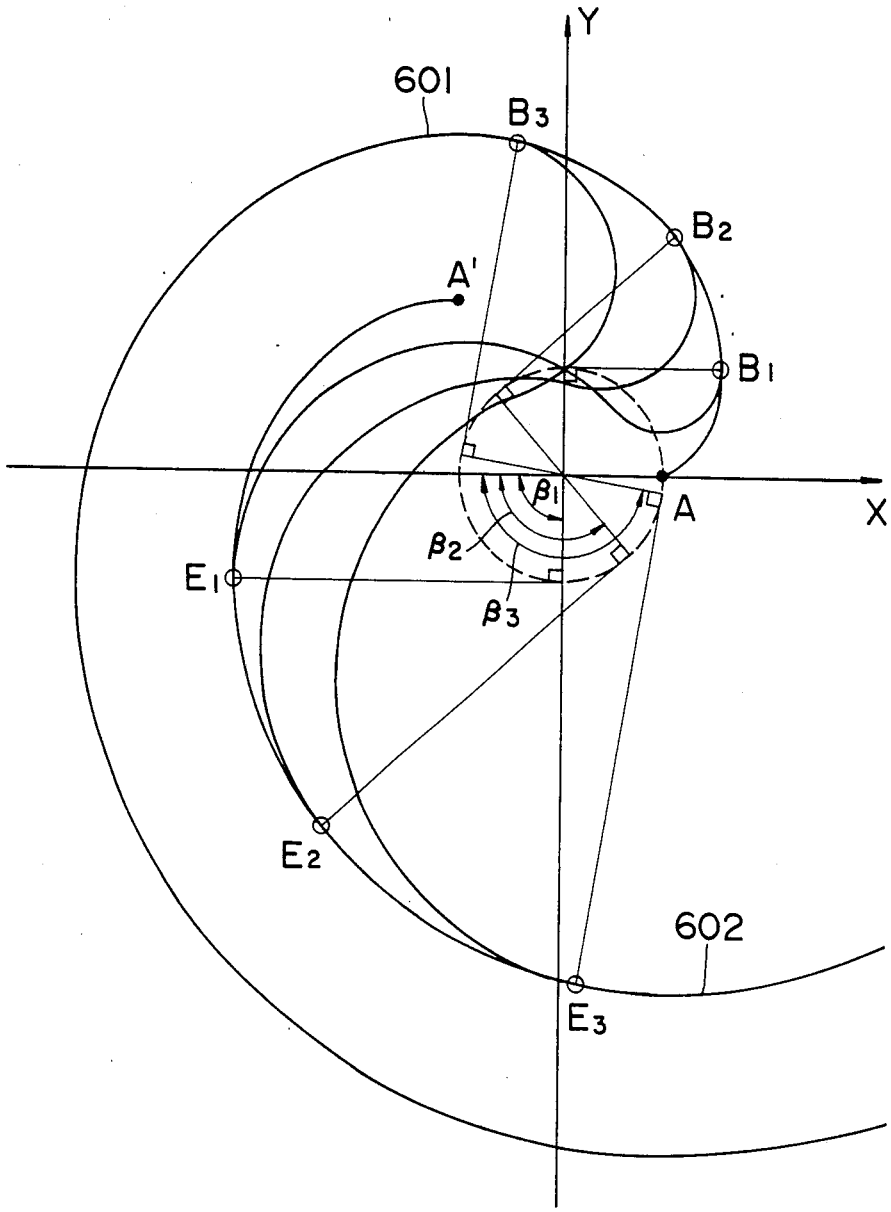
FIG. 1 is a schematic front elevational view showing the configuration of a scroll or spiral element incorporated in the rotary type fluid machine by way of a preferred embodiment of the present invention.
Figure 7:
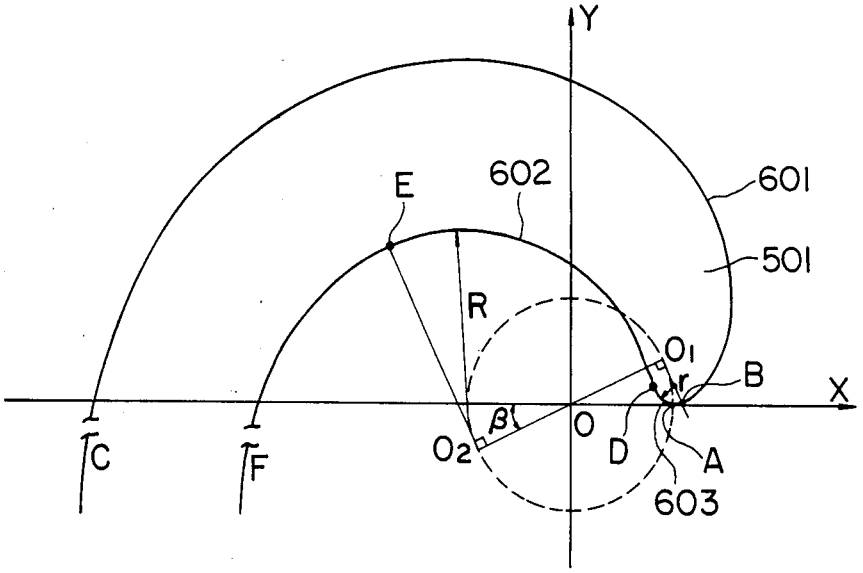
FIG. 7 Prior Art
FIG. 7 is a schematic view showing the configuration of the spiral element as disclosed to be adapted in the rotary-type fluid machine disclosed in the Japanese patent application No. 206,088/1982.

Firstly referring to FIG. 1, shown in correspondence with FIG. 7, the like parts shown are designated at the like reference numerals. According to this construction, there is shown the detailed confirguration of the spiral element, in which there are given curvature parameters $\beta_1$, $\beta_2$ and $\beta_3$, the mutual relationship of these parameters is $\beta_1<\beta_2<\beta_3$, and with which parameters, it is seen that the radii R and r of the arc sections defined in the involute curve at the inner leading end of the spiral element grow greater as the parameter $\beta$ would become greater.

In this drawing figure, there is shown a point A which is the starting point of an involute curve having a base circle radius b. Also, there is shown a point A', which is a point on the involute curve of the base circle radius b shifted in its angular phase of $(\pi-b/\rho)$, and which is the specific point where it would come to engage relatively with the point A on the complementary spiral element. The points $B_1$, $B_2$ and $B_3$ are marginal points for the radially outer curve of the spiral element with the parameter $\beta$ being $\beta_1$, $\beta_2$ and $\beta_3$ respectively.

Now, the points $E_1$, $E_2$ and $E_3$ are marginal points for the radially inner curve of the spiral element with the parameter $\beta$ being $\beta_1$, $\beta_2$ and $\beta_3$, respectively. Also, points $B_1$ and $E_1$, points $B_2$ and $E_2$, and points $B_3$ and $E_3$ are abutting points where the spiral element in question may come to engage with the complementary element, respectively.

As apparently seen from this figure, the greater the parameter $\beta$, thicker the inner leading end of the spiral element would grow, thus making available a greater rigidity of this specific leading end portion, accordingly. It is also notable that a stress to be produced in the inner leading end of the spiral element as shown previously by way of the arrow in FIG. 4 (A) would then become smaller as typically appreciable in FIG. 2, as the matter of course.

Figure 2:
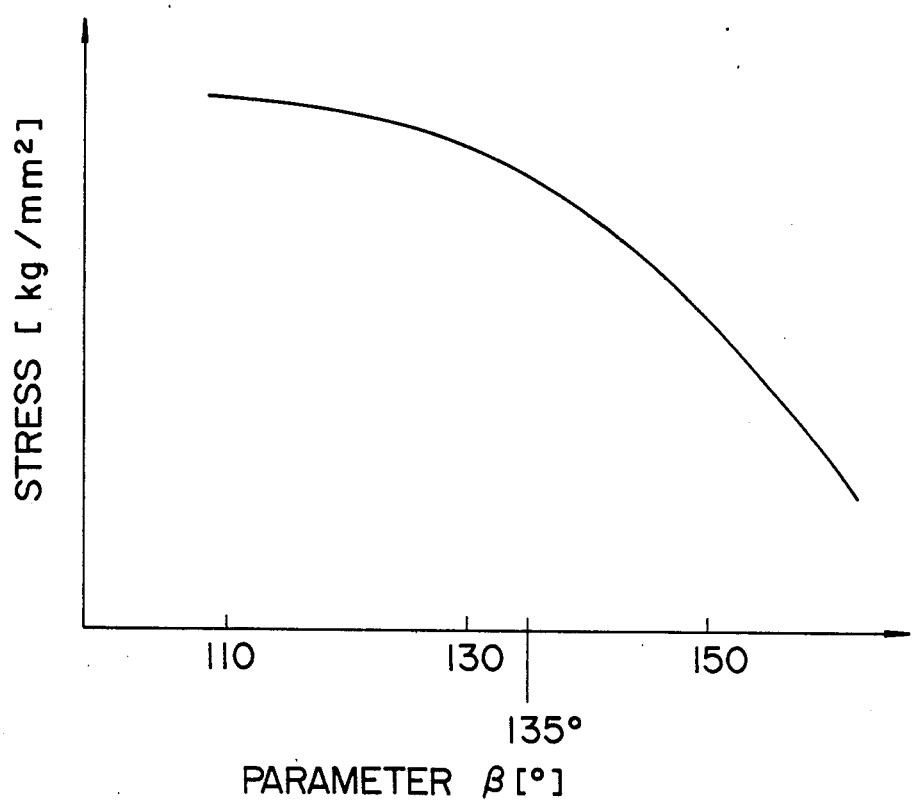
FIG. 2 is a graphic representation showing the mutual relationship between the parameter $\beta$ and the stress working on the inner leading end of the spiral element shown in FIG.1.
Figure 3:
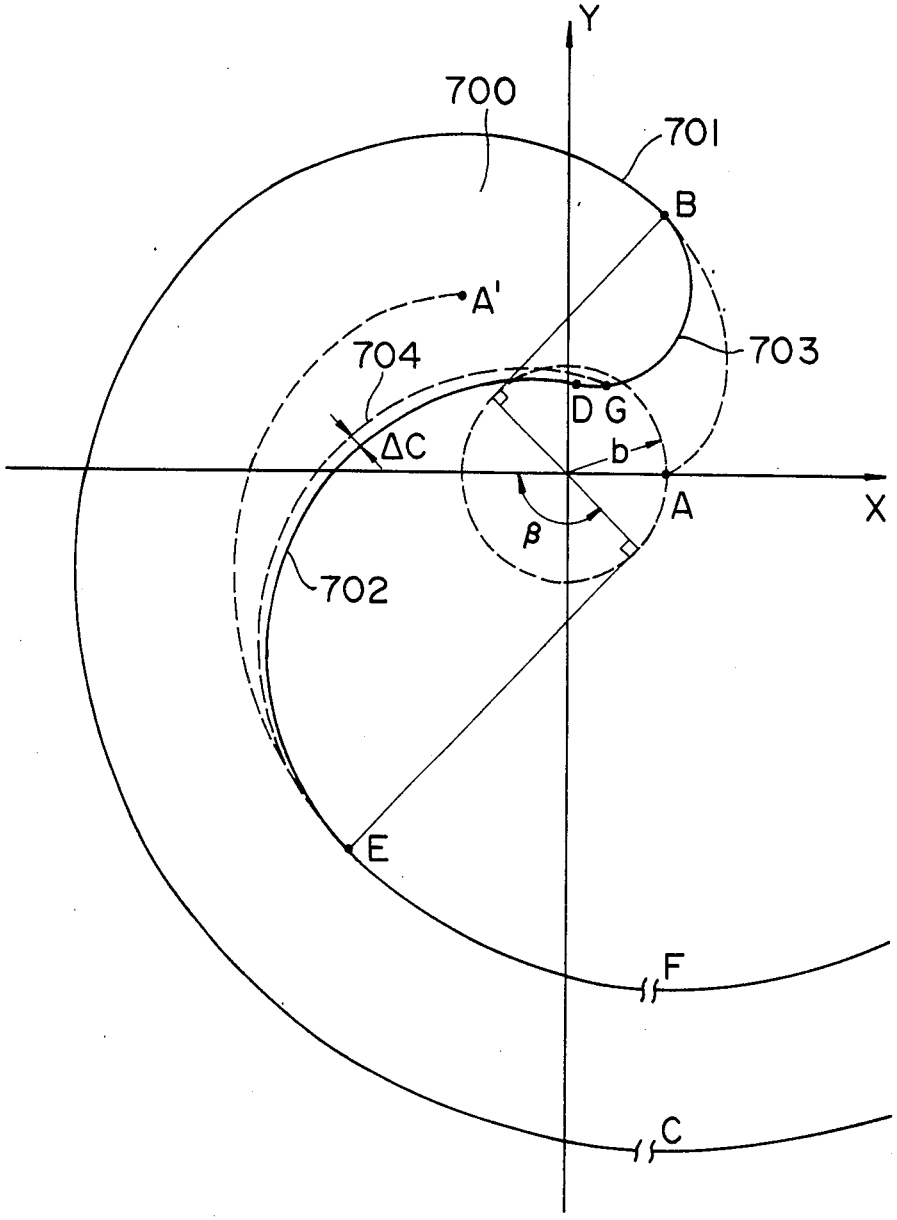
FIG. 3 is a similar elevational view to FIG. 1 showing the configuration of the spiral element shown in FIG. 1 with the parameter $\beta$ of 135 degrees.
Figure 4A:
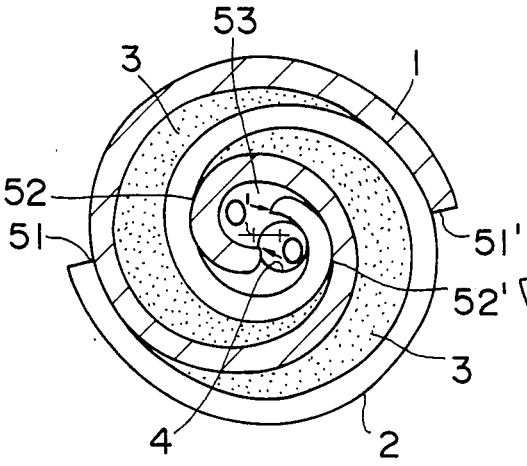
FIGS. 4 (A) through (D) are a series of schematic views showing the principle of operation of the prior art scroll-type compressor.
Figure 4B:
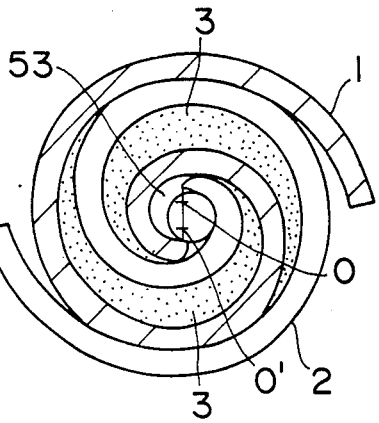
Figure 4C:
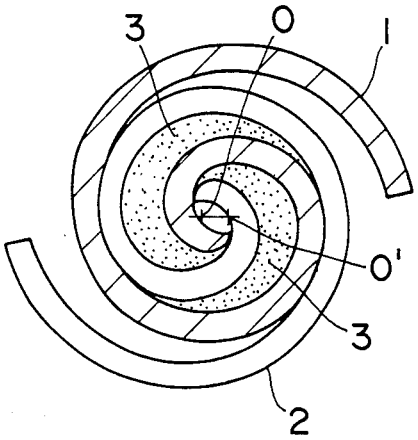
Figure 4D:
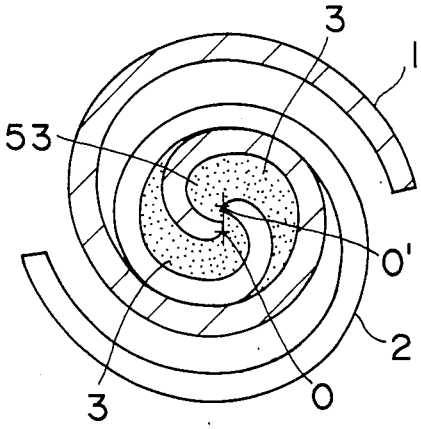
Figure 5:
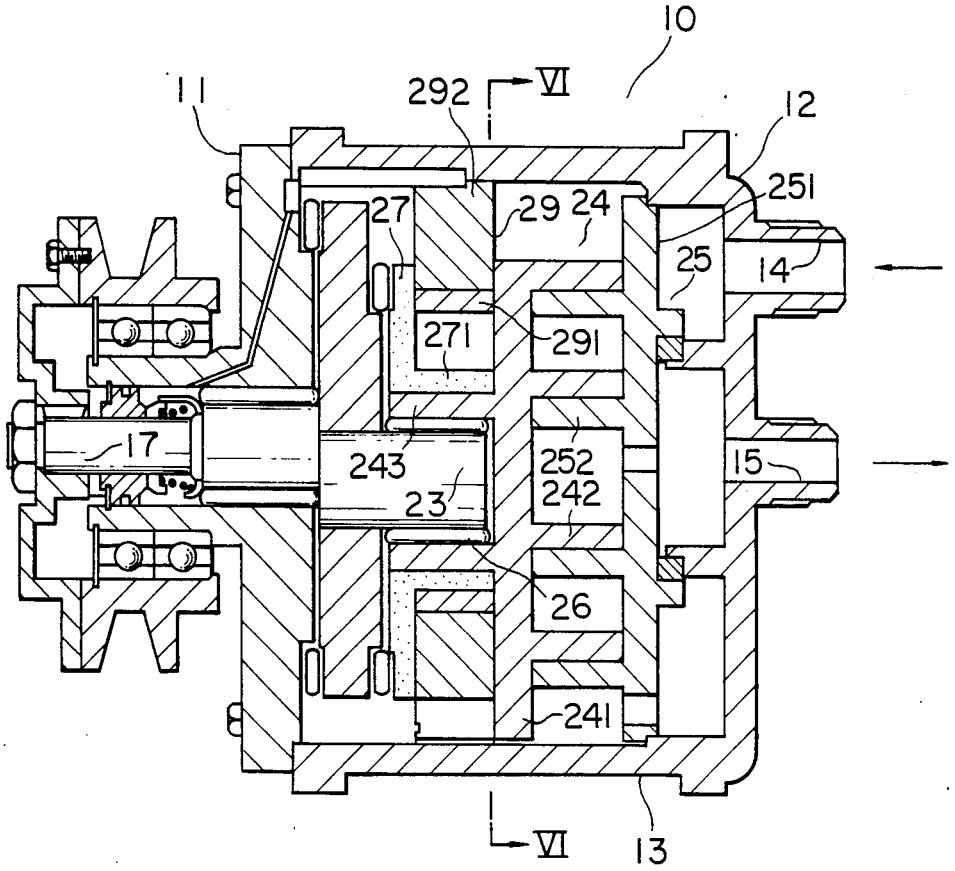
FIG. 5 is a longitudinal cross-sectional view showing the general construction of the prior art scroll-type compressor.
Figure 6:
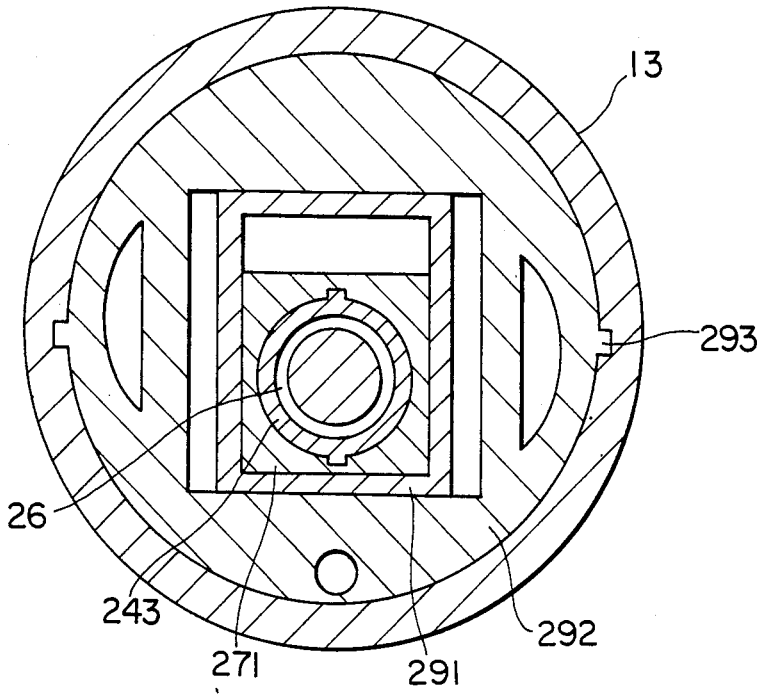
FIG. 6 is a transversal cross-sectional view taken along the line VI—VI in FIG. 5.

When with the angular parameter $\beta$ being 135 degrees or greater, in consideration of the fact that the stress as generated in the inner leading end of the spiral element could be made markedly smaller as appreciated in FIG. 2, it would be readily notable that a risk of cracking or damage, as encountered in the inner leading end of the spiral element of the conventional design, when put under a high load during the operation, may well be prevented from occurring, accordingly.

FIG. 3 is a detailed representation showing the profile of the spiral element with the angular parameter $\beta$ of 135 degrees. In this drawing figure, there is shown a stationary spiral element designated at the reference numeral 700, wherein a radially inner curve and a radially outer curve of the spiral element are designated at 702 and 701, respectively, and also a transition or connection curve is shown at 703. The relationship of locations of other points A, A', E, B, F and C is identical with those shown in the embodiment stated hereinbefore, and this geometric relationship in the complementary spiral element holds good in the like manner.

With the angular parameter $\beta$ being further greater than 135 degrees according to the principle of the present invention, it is advantageous that the rigidity of the inner leading end of the spiral element, which turns out to be smallest in the whole element construction, would then grow sufficient to a satisfactory practice in use. In this respect, it is now feasible in practice to have a properly increased height of the spiral element to be incorporated into the rotary fluid machine, without increasing the overall outer diameter of the spiral element, thus contributing to a substantial increase in the designed displacement of the fluid machine, accordingly.

In connection with the advantageous construction of the spiral elements as incorporated in the rotary fluid machine particular to the present invention, there may be attained many useful modifications and variations in practice, as follows.

They are:

(1) As typically shown in FIG. 3 with a broken line, there may also be defined an alternative radially inner curve 704 in the curvilinear section E-G with a small clearance or relief $\Delta C$, which is recessed radially outwardly of the inner curve 702. In this configuration, the point G is an arbitrary point existing intermediate the points D and B on the connection curve 703, which relief $\Delta C$ is exaggerated in scale from the actual extent of recess for the clarity in the illustration, and which relief may be made to a very small extent.

(2) In place of the provision of the relief $\Delta C$ in the radially inner curve, there may of course be provided an alternative recess or relief $\Delta C$ on the part of the connection curve, or in the both connection curve 703 and radially outer curve 701. 15 can be held properly in position.

(3) An alternative configuration is such that one spiral element may be as shown in FIG. 1 and only the complementary spiral element may be provided with curvilinear relief $\Delta C$, which may be formed in combination of the profiles of the inner curve and connection curve, or including the outer curve as noted in the paragraphs (1) and (2) above.

(4) Also, there may be adopted such an alternative construction that the both spiral elements are formed with a small recess to define a clearance therebetween on the part of the inner curve and connection curve, or including the outer curve, either.

In either case of element profiles, there is defined only a small clearance $\Delta C$ therebetween, which may efficiently bring the advantageous effect as intended by way of the Japanese patent application No. 206,088/1982 so designed, thus resulting in a due improvement in the efficiency of the fluid machine, accordingly.

(5) In summary, it is to be noted that the present invention may accordingly be adapted to an equal effectual result to any installations, which incorporate the scroll or spiral elements therein such as a fluid compressor, a pump unit, a fluid expander, and the like.

While the typical preferred embodiments of the present invention has been described fully hereinbefore, it is to be understood that the present invention is not intended to be restricted to the details of the specific constructions shown in the preferred embodiments, but to contrary, many changes and modifications may be made in the foregoing teachings without any restriction thereto and without departing from the spirit and scope of the invention.

It is also to be understood that the appended claims are intended to cover all of such generic and specific features particular to the invention as disclosed herein and all statements relating to the scope of the invention, which as a matter of language might be said to fall thereunder.

What is claimed is:

1. A rotary type fluid machine comprising stationary spiral means and revolving spiral means respectively having a substantially identical configuration and disposed 180 degrees apart from each other in mutually nested relationship, said revolving spiral means being adapted to resolve in solar motion relationship with respect to said stationary spiral means with a radius of revolutionary motion $\rho$, wherein said both spiral means are respectively formed by an outer curve consisting of an involute curve, an inner curve consisting of another involute curve having an inner arc of radius R, and an arc of a radius r connecting smoothly said outer curve and said arc having the radius R, in accordance with the geometrical relationship as given by the following equations;

$$R = \rho + b\beta + d$$
$$r = b\beta + d$$

$$d = \frac{b^2 - \left(\frac{\rho}{2} + b\beta\right)^2}{2\left(\frac{\rho}{2} + b\beta\right)}$$

where, $\beta \geqq 135°$, and b is the radius of a base circle of said involute curve.

* * * * *